US005314181A

United States Patent [19]

Lin

[11] Patent Number: 5,314,181

[45] Date of Patent: May 24, 1994

[54] TIMING AND TALKING MARBLES GAME TOY

[76] Inventor: Wen-Tsung Lin, P.O. Box 74-9, Taipei, Taiwan

[21] Appl. No.: 57,864

[22] Filed: May 7, 1993

[51] Int. Cl.[5] ..... A63F 7/00

[52] U.S. Cl. ..... 273/109; 273/123 A; 273/454; 273/153 R

[58] Field of Search ..... 273/108, 109, 112, 118, 273/123, 440, 454, 455, 153 R

[56] References Cited

U.S. PATENT DOCUMENTS

| | | | |
|---|---|---|---|
| 3,712,617 | 1/1973 | Ohlschlager | 273/108 X |
| 4,850,592 | 7/1989 | Winter | 273/109 |
| 4,964,637 | 10/1990 | Gebert | 273/109 X |
| 5,112,052 | 5/1992 | Yamaura | 273/108 X |

FOREIGN PATENT DOCUMENTS

| | | | |
|---|---|---|---|
| 1703151 | 1/1992 | U.S.S.R. | 273/108 |

*Primary Examiner*—Vincent Millin
*Assistant Examiner*—Raleigh W. Chiu

[57] ABSTRACT

A timing and talking game toy includes: a board casing have a plurality of baffles and lanes irregularly formed in the casing for running a ball in the lanes as guided or limited by the baffles from a starting point to a finishing point, a plurality of lamps juxtapositionally mounted on the board which are all lit up when starting the running of the ball and are subsequently switched off with respect to a lapse of time counted by a timing circuit of a central processing unit (CPU) and a talking integrated circuit controlled by the CPU for a voice speaking, indicating the status for running the ball to the finishing point corresponding to the number of the lamps being switched off within a pre-determined time period for interesting the game player.

9 Claims, 4 Drawing Sheets

TIMING AND TALKING MARBLES GAME TOY

BACKGROUND OF THE INVENTION

A conventional balancing marbles game as shown in FIG. 1 includes a marble or ball B running on a game board of a casing C, in which the ball B should be well manipulated to run along a path P of the ball to be guided by the guiding baffles G without being trapped into the ball holes H recessed on the board plate of the casing C. Such a conventional marbles game is not provided with any electronic timing or talking functions, thereby lacking of its playing interest.

SUMMARY OF THE INVENTION

The object of the present invention is to provide a timing and talking game toy including: a board casing have a plurality of baffles and lanes irregularly formed in the board casing for running a ball in the lanes as guided or limited by the baffles from a starting point to a finishing point, a plurality of lamps juxtapositionally mounted on the board which are all lit up when starting the running of the ball and are subsequently switched off with respect to a time lapse counted by a timing circuit of a central processing unit (CPU) and a talking integrated circuit controlled by the CPU for a voice speaking, indicating the status for running the ball to the finishing point corresponding to the number of the lamps being switched off within a pre-determined time period for interesting the game player.

DETAILED DESCRIPTION

Figure 1:
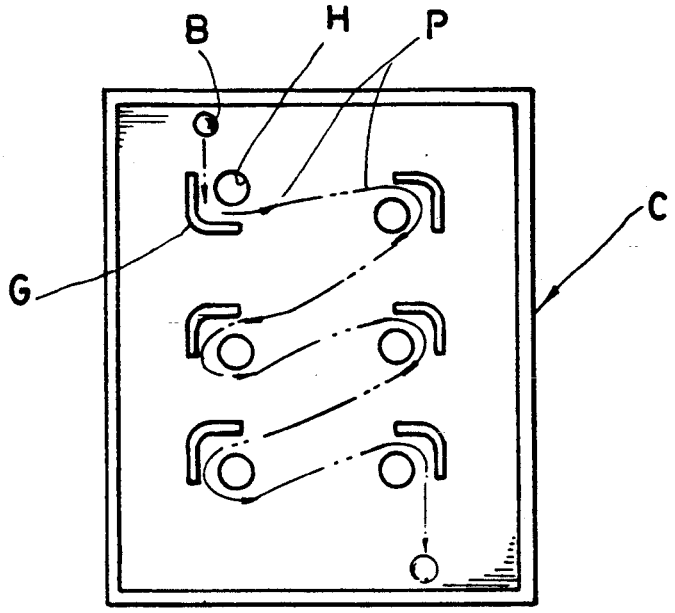
FIG. 1 shows a prior art of a conventional marbles game toy.

As shown in the drawings, the present invention comprises: a board casing 1 having a base 11, a transparent cover 12 sealably mounted on the base 11, and a marbles board 13 mounted on the base 11 under the transparent cover 12; a ball 2 movably running on the marbles board 13 from a starting point 16*a* towards a finishing point 16*b* formed on the marbles board 13 by any running path 21 on the board 13; an illuminating and talking circuit 3 mounted in the casing 1 having a plurality of lamps L1–L5 juxtapositionally mounted in the casing 1 and electrically connected to a central processing unit IC1 and operatively switched on to light up all the lamps when the ball 2 starts at the starting point 16*a* to switch on a starting switch S2 to start an operation of the central processing unit IC1 of the illuminating and talking circuit 3, the central processing unit IC1 operatively subsequently switching off each the lamp L1 to L5 with respect to a time lapse based on a timing circuit (not shown) of the central processing unit IC1 and operatively triggering a talking integrated circuit IC1 to give a voice warning in response to each switching off of the lamp L1 to L5, and the central processing unit IC1 operatively counting the number of te lamps not switched off when the ball 2 reaches the finishing point 16*b* to drive the talking integrated circuit for producing a voice indicating a status of the lamps being lit or switched off within a predetermined time period; and a power source 4 electrically connected to the illuminating and talking circuit 3 having a power switch S1 operatively switched on or off by a push button 41 formed on the casing 1.

The lamps L1 to L5 may be selected from light emitting diodes (LED), bulbs, or any other illuminators and are not limited in this invention. The board 13 may be generally horizontally held for balancing the running ball 2 or inclinedly held for moving the ball 2.

The board casing 1 includes: the base 11 for mounting the illuminating and talking circuit 3 in the base 11, the marbles board 13 secured on an upper portion of the base 11 for shielding the illuminating and talking circuit 3 in the base 11, and the transparent cover 12 mounted on the base 11 to also cover the marbles board 13, having the plurality of lamps L1–L5 protruding upwardly through the board 13 to be positioned in between the board 13 and the cover 12 for displaying the illumination of the lamps.

The cover 12 has a plurality of baffles 15 secured to the cover 12 and protruding downwardly towards the marbles board 13 to define a plurality of running lanes 16 among the baffles 15 and confining a plurality of running paths 21 of a ball 2 rolling in the lanes 16 among the baffles 15 from the starting point 16*a* towards the finishing point 16*b*. The baffles 15 and lanes 16 may also be formed on the marbles board 13.

The shapes of the baffles 15 are not limited in this invention, which are preferably circular or arcuate shape. The board 13 may be formed as a circular shape.

The marbles board 13 is formed with a ball socket or groove 14 recessed in the board 13 between the starting point 16*a* and the finishing point 16*b* for a stand-by position of the ball 2 before its running and playing.

Figure 2:
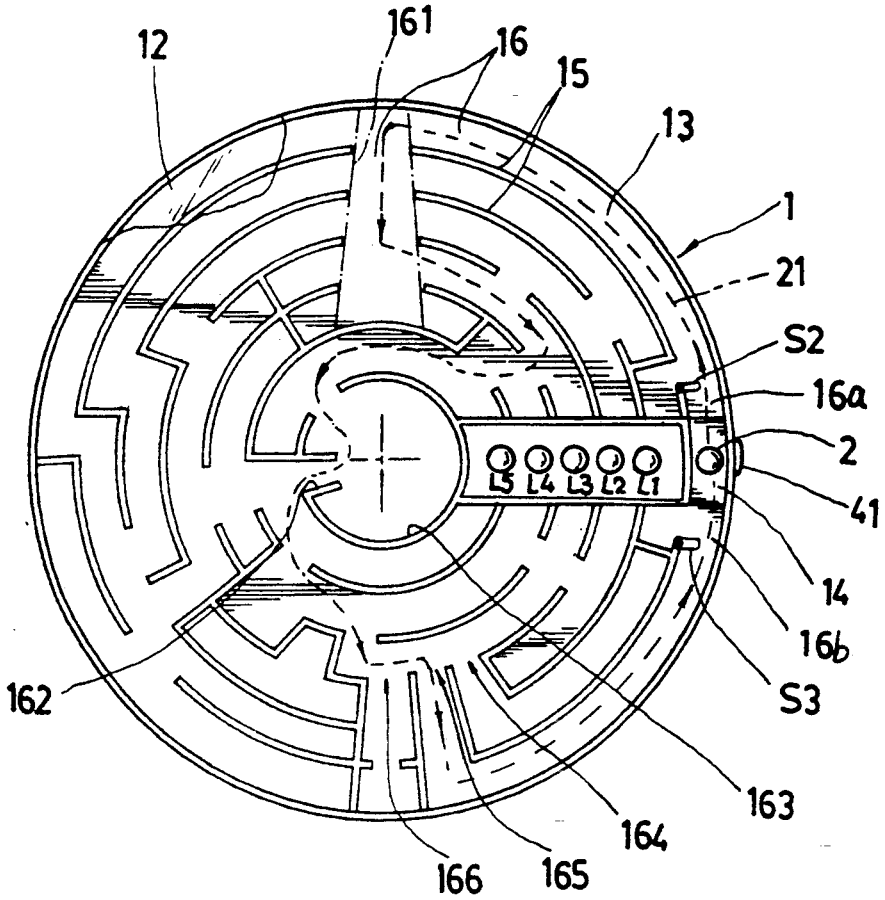
FIG. 2 is a top view illustration of the present invention.
Figure 3:
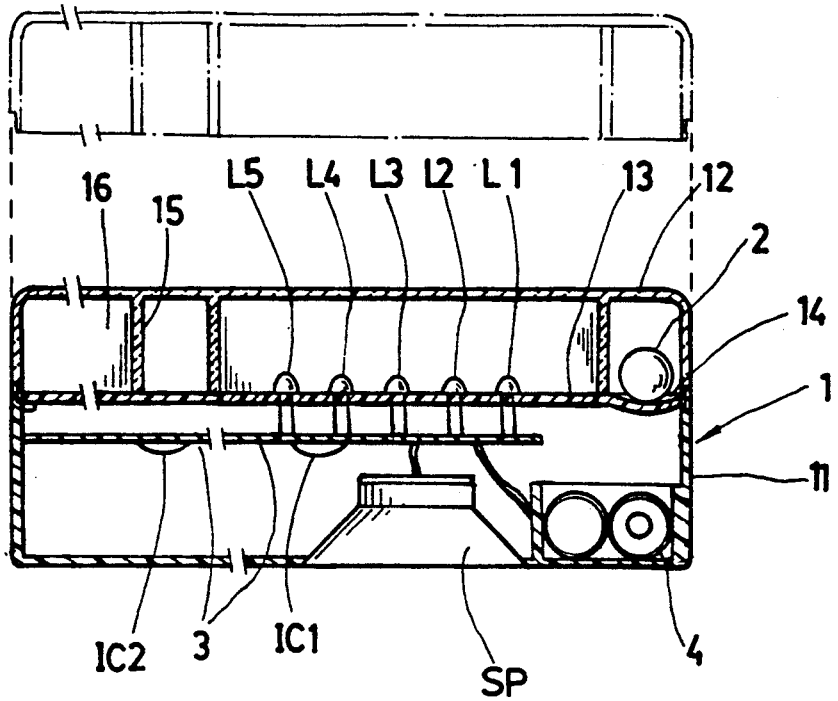
FIG. 3 is a side-view partial sectional drawing of the present invention.
Figure 4:
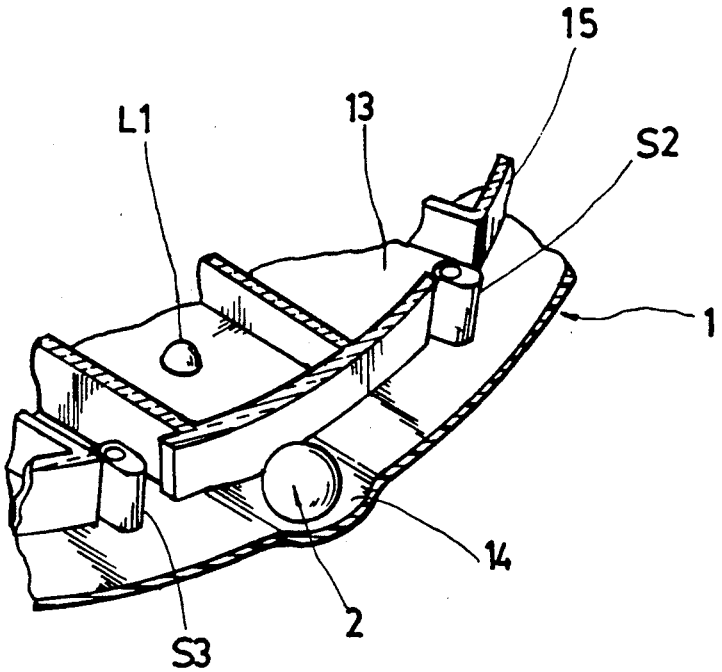
FIG. 4 is a partial respective view showing a stand-by condition before starting the playing of the present invention.
Figure 5:
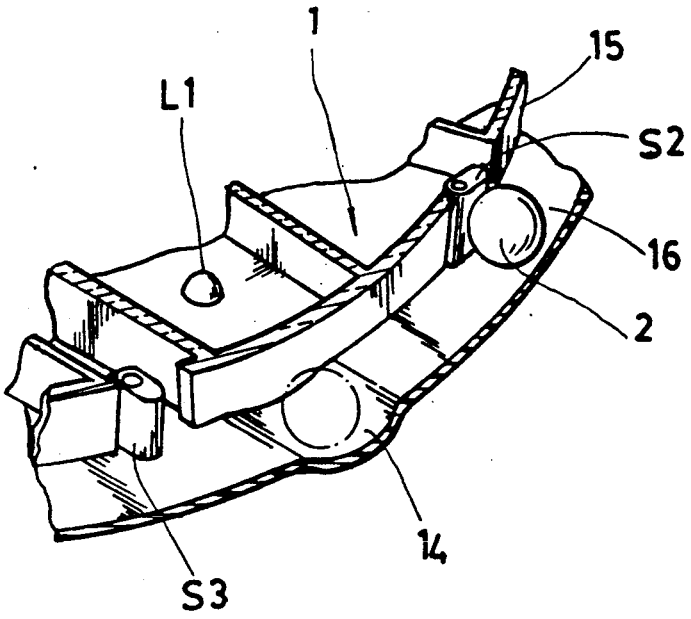
FIG. 5 shows a start of the present invention.
Figure 6:
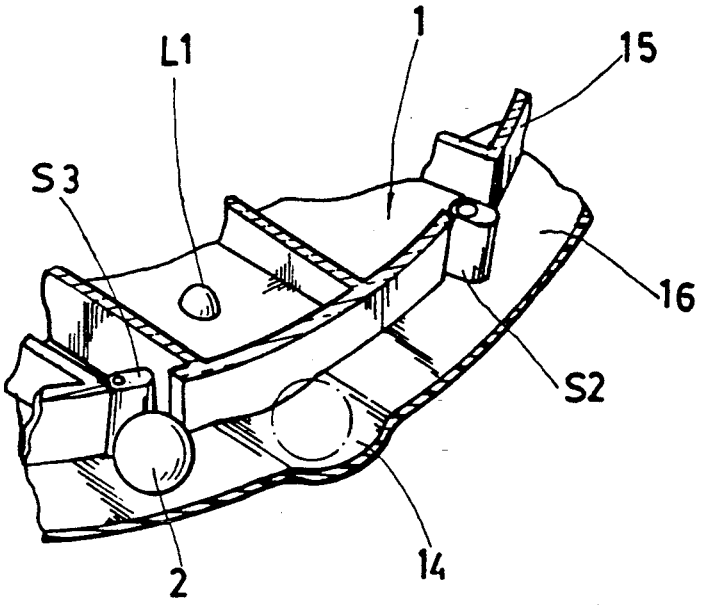
FIG. 6 shows a finish of the present invention.
Figure 7:
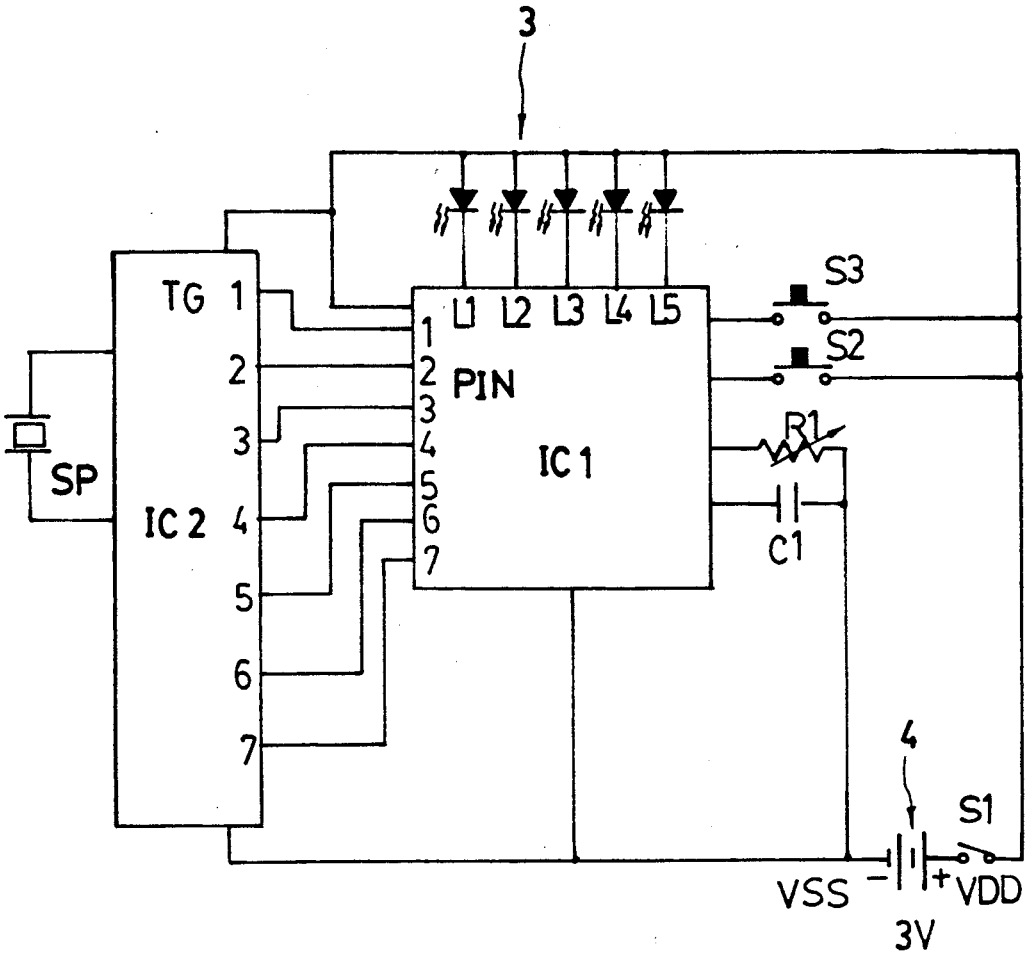
FIG. 7 is a circuit diagram in accordance with the present invention.

As shown in FIG. 2, there is provided with a diverging lane 161 diverging inwardly from a periphery of the board towards a center of the board 13 intersecting a plurality of concentric lanes, so that it will be more difficult to run a ball 2 from an outer periphery towards the board center and then towards the finishing point 16*b* by passing through the baffles 15 and lanes 16 to thereby increase the playing interest of the invention.

Near the center of the board 13, an outlet port 162 is formed in a circularly-shaped baffle 163 having a smooth curvature to decrease the guiding opportunity of the ball 2 and to increase the difficulty of the ball to leave the port 162, thereby increasing the playing interest of the present invention.

For minimizing the probabilities of the ball 2 to enter the correct outlet channel 165, plural (or two) side channels 164, 166 are disposed on two sides of the central channel 165 as shown in FIG. 2.

Naturally, the baffles 15 and lanes 16 may be optionally modified to diversify their structures, shapes, orientations, number and sizes, without being limited in the present invention.

The illuminating and talking circuit 3 has the central processing unit (CPU) IC1 provided with a pluality of lighting-signal output pins Pin 1, 2, 3, 4, 5 respectively connected to a plurality of lighting-signal trigger pins TG 1, 2, 3, 4, 5 of the talking integrated circuit IC2 which is electrically connected to a speaker SP or buzzer for transferring output lighting signals from CPU IC1 by respectively counting the number of illuminating lamps from one lamp to five lamps to drive the talking integrated circuit IC2 to give the respective voice or indication corresponding to the number of illuminating lamps when the ball 2 reaches the finishing point 16*b* to actuate the finishing switch S3, for instance, TG5 triggering a speech of "Oh, the greatest!" due to all 5 lamps being lit; TG1 triggering a speech of "Don't be disappointed, go ahead!" if only one lamp being lit; provided with a single-unlit-signal output pin Pin 7 connected to an unlit-signal trigger pin TG 7 of the talking integrated circuit IC2 to transfer an unlit signal when switching off every lighting lamp from CPU IC1 to the talking integrated circuit IC2 to give a voice warning, such as "go-go!"; and provided with a total-unlit-signal output pin Pin 6 connected to a total-unlit-signal trigger pin TG 6 of IC2 to transfer a signal when switching all lamps from CPU IC1 to the talking integrated circuit IC2 to give a voice reminder to advise a re-play of a marbles game of the present invention and then to reset a timing circuit ready for a next timing operation when triggering the starting switch S2 of the illuminating and talking circuit 3.

The timing circuit of the illuminating and talking circuit 3 includes a timing device reversely counting a time in a preset time period which is divided into a plurality of time intervals each time interval corresponding to a time lapse from a lighting of a lamp to an unlit condition of the lamp of the illuminating and talking circuit 3 and which is started from a triggering of a starting switch S2 of the illuminating and talking circuit 3 when all lamps L1–L5 are lit.

The time interval of the timing circuit of the illuminating and talking circuit 3 is varied by adjusting a timing (RC) constant of a resistor R1 and a capacitor C1 electrically connected to the central processing unit IC1.

The starting switch S2 and the finishing switch S3 are each made as an one-way actuating switch, allowing an one-direction triggering only by a forward running of the ball 2, other than a backward rolling of the ball 2 to thereby prevent a false counting or operation of the circuit 3.

The casing 1 may be formed with an access, or a lid detachably removed or opened from the casing 1 for replacing batteries of the power source 4.

The CPU IC1 and IC2 may be well designed and programmed by those skilled in the art, which are not limited in this invention.

I claim:

1. A game toy comprising:

a board easing having a base, a transparent cover sealably mounted on the base, and a marbles board mounted on the base under the transparent cover;

an illuminating and talking circuit including a central processing unit, a timing circuit and a talking integrated circuit, and mounted in the casing having a plurality of lamps juxtapositionally mounted in the casing and electrically connected to said central processing unit, and operatively switched on to left up all the lamps when the ball starts at the starting point to switch on a starting switch to start an operation of the central processing unit of the illuminating and talking circuit, the central processing unit operatively subsequently switching off each of the lamps with respect to a time lapse based on said timing circuit of the central processing unit and operatively triggering said talking integrated circuit of said illuminating and talking circuit to give a voice warning in response to each switching off of the lamp, and the central processing unit operatively counting the number of the lamps not switched off when the ball reaches the finishing point to drive the talking integrated circuit for producing a voice indicating a status of the lamps being lit or switched off within a predetermined time period; and a power source electrically connected to the illuminating and talking circuit for powering the same.

2. A game toy according to claim 1, wherein said lamps are selected from a light emitting diode and a bulb.

3. A game toy according to claim 1, wherein said board casing includes: a base for mounting the illuminating and talking circuit in the base, the marbles board secured on an upper portion of the base for shielding the illuminating and talking circuit in the base, and the transparent cover mounted on the base to cover the marbles board, having the plurality of lamps protruding upwardly through the board to be positioned in between the board and the cover for display use.

4. A game toy according to claim 3, wherein said casing has a plurality of baffles secured to the cover and protruding downwardly towards the marbles board confining a plurality of running lanes of a ball rolling in the lanes among the baffles from the starting point towards the finishing point.

5. A game toy according to claim 4, wherein said marbles board is formed with a ball socket recessed in the board between the starting point and the finishing point for a stand-by position of the ball before running the ball.

6. A game toy according to claim 1, wherein said central processing unit (CPU) of said illuminating and talking circuit includes a plurality of lighting-signal output pins; and said talking integrated circuit includes a speaker and a plurality of lighting-signal trigger pins electrically connected with said plurality of said lighting-signal output pins of said CPU for transferring output lighting signals from said CPU to said talking integrated circuit by respectively counting the number of illuminating lamps from a single lamp to total lamps to drive the talking integrated circuit to give the respective voice through said speaker corresponding to the number of illuminating lamps when the ball reaches the finishing point to actuate the finishing switch; said CPU including a single-unlit-signal output pin and said talking integrated circuit including an unlit-signal trigger pin connected to said single-unlit-signal output pin of said CPU to transfer an unlit signal when switching off every lighting from said CPU to the talking integrated circuit to give a voice warning; and said CPU including a total-unlit-signal output pin and said talking integrated circuit including a total-unlit-signal trigger pin connected to said total-unlit-signal output pin of said CPU to transfer a signal when switching all said lamps from said CPU to said talking integrated circuit to give a voice reminder to advise a re-play of a marbles game and to reset a timing circuit ready for a next timing operation when triggering the starting switch of the illuminating and talking circuit.

7. A game toy according to claim 6, wherein said timing circuit of the illuminating and talking circuit includes a timing device reversely counting a time in a preset time period which is divided into a plurality of time intervals each said time interval corresponding to a time lapse from a lighting of a lamp to a switching off of the lamp of the illuminating and talking circuit and which is started from a triggering of a starting switch of the illuminating and talking circuit when all said lamps are lit.

8. A game toy according to claim 7, wherein each said time interval of the timing circuit of the illuminating and talking circuit is varied by adjusting a timing constant of a resistor and a capacitor electrically connected to the central processing unit.

9. A game toy according to claim 1, wherein said starting switch and said finishing switch are one-way actuating switch to be actuated only by a forward running of the ball.

* * * * *